US006450336B1

(12) United States Patent
Edes

(10) Patent No.: US 6,450,336 B1
(45) Date of Patent: Sep. 17, 2002

(54) PROTECTIVE PAINTING UTENSIL SLEEVE

(76) Inventor: Brian Edes, 7 Redgrave Place, Marlow Buckinghamshire SL7 1JZ (GB)

( * ) Notice: Subject to any disclaimer, the term of this patent is extended or adjusted under 35 U.S.C. 154(b) by 3 days.

(21) Appl. No.: 09/675,187

(22) Filed: Sep. 29, 2000

(51) Int. Cl.[7] ..... B65D 81/00; A46B 17/04

(52) U.S. Cl. ..... 206/361; 15/247; 150/161; 206/209

(58) Field of Search ..... 206/361, 306, 206/209; 150/161; 15/246, 247, 143.1, 159.1, 174, 175

(56) References Cited

U.S. PATENT DOCUMENTS

| | | | | | |
|---|---|---|---|---|---|
| 2,485,068 | A | | 10/1949 | Santana | |
| 3,136,409 | A | * | 6/1964 | Schumann | 206/361 |
| 3,167,178 | A | * | 1/1965 | Saunders | 206/361 |
| 3,837,091 | A | | 9/1974 | Meyer | |
| 4,384,382 | A | | 5/1983 | Diamant | |
| 4,469,223 | A | * | 9/1984 | Smith | 206/361 |
| 4,847,939 | A | | 7/1989 | Derencsenyi et al. | |
| D329,144 | S | | 9/1992 | Kurtz | |
| 5,174,445 | A | * | 12/1992 | Mull | 206/361 |
| 5,228,851 | A | * | 7/1993 | Burton | 206/306 |
| D350,234 | S | | 9/1994 | Losole | |

* cited by examiner

*Primary Examiner*—Bryon P. Gehman

(57) ABSTRACT

A protective painting utensil sleeve for preventing the drying out of painting utensil. The protective painting utensil sleeve includes a protective painting utensil sleeve device comprising of a sheath. The sheath includes a first panel and a second panel. Each of the panels includes a first edge, a second edge, a third edge and a fourth edge. The inventive device also includes a peripheral side wall extending between and integrally coupled to the first, the second and the third edges, such that an opening is defined between the fourth edges.

7 Claims, 1 Drawing Sheet

PROTECTIVE PAINTING UTENSIL SLEEVE

BACKGROUND OF THE INVENTION

1. Field of the Invention

The present invention relates to brush covers and more particularly pertains to a new protective painting utensil sleeve for preventing the drying out of painting utensils.

2. Description of the Prior Art

The use of painting utensil covers is known in the prior art. More specifically, painting utensil covers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,485,068; U.S. Pat. No. Des. 329,144; U.S. Pat. No. Des. 350,234; U.S. Pat. Nos. 3,837,091; 4,847,939; and 4,384,382.

While these devices fulfill their respective, particular objectives and requirements, the aforementioned patents do not disclose a new protective painting utensil sleeve. The inventive device includes a protective painting utensil sleeve device comprising of a sheath. The sheath includes a first panel and a second panel. Each of the panels includes. a first edge, a second edge, a third edge and a fourth edge. The inventive device also includes a peripheral side wall extending between and integrally coupled to the first, the second and the third edges, such that an opening is defined between the fourth edges.

In these respects, the protective painting utensil sleeve according to the present invention substantially departs from the conventional concepts and designs of the prior art, and in so doing provides an apparatus primarily developed for the purpose of preventing the drying out of painting utensils.

SUMMARY OF THE INVENTION

In view of the foregoing disadvantages inherent in the known types of painting utensil covers now present in the prior art, the present invention provides a new protective painting utensil sleeve construction wherein the same can be utilized for preventing the drying out of painting utensils.

The general purpose of the present invention, which will be described subsequently in greater detail, is to provide a new protective painting utensil sleeve apparatus and method which has many of the advantages of the painting utensil covers mentioned heretofore and many novel features that result in a new protective painting utensil sleeve which is not anticipated, rendered obvious, suggested, or even implied by any of the prior art painting utensil covers, either alone or in any combination thereof.

To attain this, the present invention generally comprises a protective painting utensil sleeve device comprising a sheath. The sheath includes a first panel, and a second panel. Each of the panels includes a first edge, a second edge, a third edge, and a fourth edge. The inventive device also includes a peripheral side wall extending between and integrally coupled to the first, the second, and the third edges, such that an opening is defined between the fourth edges.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new protective painting utensil sleeve apparatus and method which has many of the advantages of the painting utensil covers mentioned heretofore and many novel features that result in a new protective painting utensil sleeve which is not anticipated, rendered obvious, suggested, or even implied by any of the prior art painting utensil covers, either alone or in any combination thereof.

It is another object of the present invention to provide a new protective painting utensil sleeve which may be easily and efficiently manufactured and marketed.

It is a further object of the present invention to provide a new protective painting utensil sleeve which is of a durable and reliable construction.

An even further object of the present invention is to provide a new protective painting utensil sleeve which is susceptible of a low cost of manufacture with regard to both materials and labor, and which accordingly is then susceptible of low prices of sale to the consuming public, thereby making such protective painting utensil sleeve economically available to the buying public.

Still yet another object of the present invention is to provide a new protective painting utensil sleeve which provides in the apparatuses and methods of the prior art some of the advantages thereof, while simultaneously overcoming some of the disadvantages normally associated therewith.

Still another object of the present invention is to provide a new protective painting utensil sleeve for preventing the drying out of painting utensils.

Yet another object of the present invention is to provide a new protective painting utensil sleeve which includes a protective painting utensil sleeve device comprising a sheath. The sheath includes a first panel, and a second panel. Each of the panels includes a first edge, a second edge, a third edge, and a fourth edge. The inventive device also includes a peripheral side wall extending between and integrally coupled to the first, the second, and the third edges, such that an opening is defined between the fourth edges.

Still yet another object of the present invention is to provide a new protective painting utensil sleeve that removes the cumbersome need of cleaning the painting utensil cover after each use, by using a cover that is disposable.

Even still another object of the present invention is to provide a new protective painting utensil sleeve that eliminates the need to wash a painting utensil between uses by creating a seal that prevents the painting utensils from drying out.

A further object of the present invention is to provide a new protective painting utensil sleeve that can be used with any type of paint.

A still further object of the present invention is to provide a new protective painting utensil sleeve that can be utilized with a plurality of painting utensils, such as a paintbrush, a paint roller or a painting pad.

A still further object of the present invention is to provide a new protective painting utensil sleeve that can be utilized prior to using a painting utensil to prevent the painting utensil from being contaminated by foreign objects.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
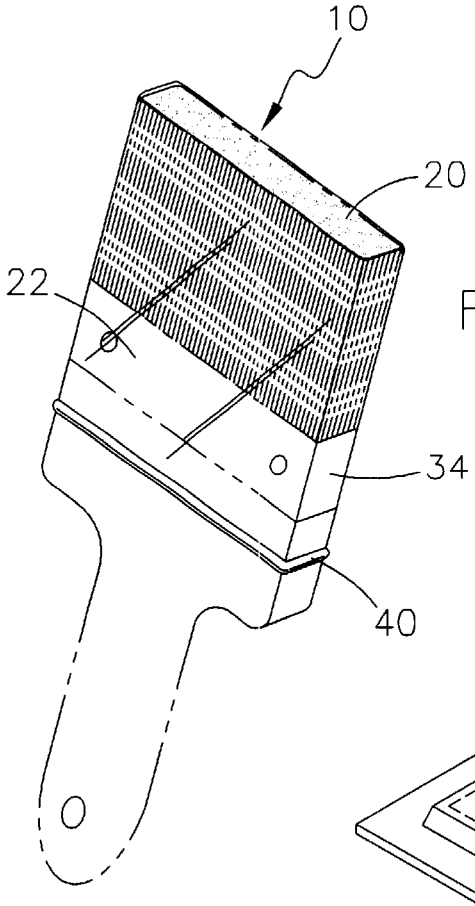
FIG. 1 is a perspective view of a new protective painting utensil sleeve according to the present invention.
Figure 2:
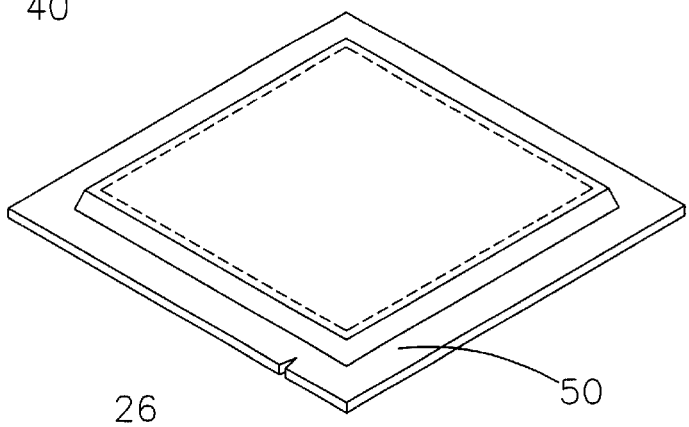
FIG. 2 is a perspective view of the present invention in its pre-use form within its packaging.
Figure 3:
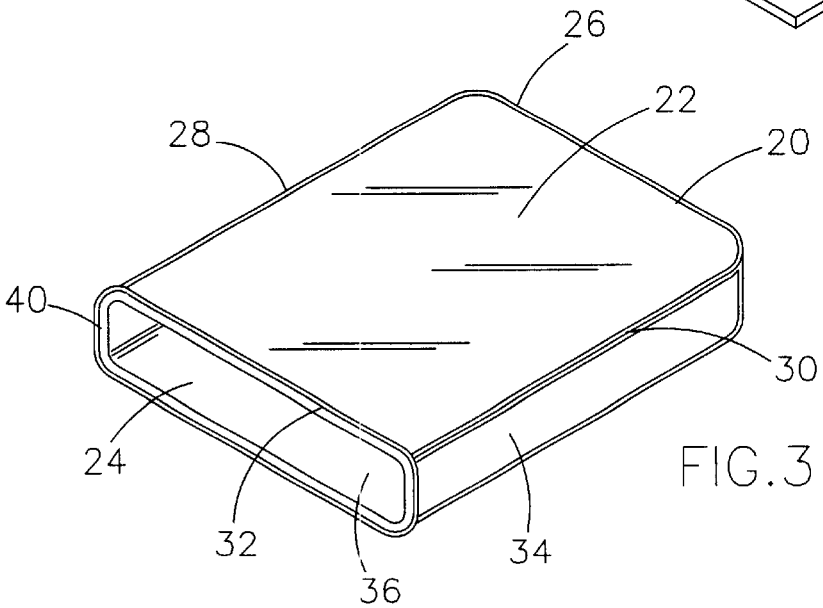
FIG. 3 is a perspective view of the present invention in its use form.

With reference now to the drawings, and in particular to FIGS. 1 through 3 thereof, a new protective painting utensil sleeve embodying the principles and concepts of the present invention and generally designated by the reference numeral 10 will be described.

As best illustrated in FIGS. 1 through 3, the protective painting utensil sleeve 10 generally comprises a protective painting utensil sleeve device comprising of a sheath 20. The sheath includes a first panel 22 and a second panel 24. Each of the panels includes a first edge 26, a second edge 28, a third edge 30, and a fourth edge 32. There is a peripheral side wall 34 extending between and integrally coupled to the first 26, the second 28, and the third edges 30, such that an opening 36 is defined between the fourth edges 32. The first panel, 22 is generally oriented parallel to the second panel 24. The first panel 22 and the second panel 24 are generally oriented perpendicular to the peripheral side wall 34. Each of the panels and the peripheral side wall 34 is made of an elastomeric material.

The protective painting utensil sleeve 10 further includes a shoulder 40. The shoulder 40 is generally adjacent to and securely attached to the fourth edges 32, such that it is extending around the opening 36 of the first panel 22, the second panel 24, and the peripheral side wall 34. The shoulder 40 is made of an elastomeric material.

In an embodiment the shoulder 40 is rolled back upon itself gathering the first panel 22, the second panel 24, and the peripheral side wall 34 to define a pre-use position.

In use, the protective painting utensil sleeve 10 allows a user to prevent the drying out of painting utensils that have been previously used. To prevent a painting utensil from being dried out, a user would remove protective painting utensil sleeve from its packaging 50, which ensures that there are no foreign objects within the protective painting utensil sleeve 10 which could contaminate the painting utensil. The protective painting utensil sleeve 10 is preferably stored in a packaging 50 similar to a conventional condom package in its pre-use rolled up form. To cover a painting utensil, such as a paintbrush, a user places the brush between their legs or some other holding device. The user then unrolls the protective painting utensil sleeve 10 over the bristles of the painting utensil. The protective painting utensil sleeve 10 would unroll until its shoulder comes into contact with the base of the painting utensil. The shoulder 40 then creates a seal that prevents the flow of air from entering the painting utensil and coming into contact with its bristles. The lack of airflow reduces the rate at which the painting utensil bristles dry out.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A protective painting utensil sleeve device comprising:

a sheath having a first panel, and a second panel, each of said panels having a first edge, a second edge, a third edge, and a fourth edge, a peripheral side wall extending between and integrally coupled to said first, said second, and said third edges to define a cavity, said fourth edges defining an opening into said cavity;

wherein said first panel, said second panel, and said peripheral side wall are each formed of a flexible material such that said panels and side wall are rollable into a roll;

wherein said sheath has a central axis extending through said opening into said cavity, a cross-sectional area of said opening taken in a plane oriented perpendicular to said central axis being substantially equal to a cross-sectional area of said cavity taken in a plane oriented perpendicular to said central axis for facilitating insertion of bristles of the painting utensil through said opening.

2. The protective painting utensil sleeve device of claim 1, further including a shoulder being generally adjacent to and securely attached to said fourth edges of said first panel, said second panel, and said peripheral side wall and said shoulder extending around said opening in a manner that does not constrict the cross sectional area of said opening smaller than the cross sectional area of said cavity.

3. The protective painting utensil sleeve device of claim 1, wherein each of said panels is made of an elastomeric material.

4. The protective painting utensil sleeve device of claim 1, wherein said shoulder is made of an elastic material.

5. The protective painting utensil sleeve device of claim 1, wherein said shoulder is capable of being rolled back upon itself gathering said first panel, said second panel and said peripheral wall to define a pre-use position.

6. A protective painting utensil sleeve device comprising:

a sheath, said sheath having a first panel, and a second panel, each of said panels having a first edge, a second edge, a third edge, and a fourth edge, a peripheral side wall extending between and integrally coupled to said first, said second, and said third edges, define a cavity, said fourth edges defining an opening into said cavity, said first panel is generally oriented parallel to said second panel, said first panel and said second panel are generally oriented perpendicular to said peripheral side wall, said first panel, said second panel, and said peripheral side wall each being formed of a flexible material such that said panels and side wall are rollable into a roll, said sheath having a central axis extending through said opening into said cavity, a cross-sectional area of said opening taken in a plane oriented perpendicular to said central axis being substantially equal to a cross-sectional area of said cavity taken in a plane oriented perpendicular to said central axis for facilitating insertion of bristles of the painting utensil through said opening, each of said panels and said peripheral side wall being made of an elastomeric material; and a shoulder, said shoulder being generally adjacent to and securely attached to said fourth edges of said first panel, said second panel, and said peripheral side wall and extending around said opening and said shoulder extending around said opening in a manner that does not constrict the cross sectional area of said opening smaller than the cross sectional area of said cavity, said shoulder being made of an elastic material; and wherein said shoulder is rolled back upon itself gathering said first panel, said second panel, and said peripheral wall to define a pre-use position.

7. A method for preventing the drying out of a painting utensil, said painting utensil having a handle, a base portion, and a set of bristles comprising the steps of:

providing a sheath, said sheath having a first panel, and a second panel, each of said panels having a first edge, a second edge, a third edge, and a fourth edge, a peripheral side wall extending between and integrally coupled to said first, said second, and said third edges, such that an opening is defined between said fourth edges, said first panel is generally oriented parallel to said second panel, said first panel and said second panel are generally oriented perpendicular to said peripheral side wall, said first panel, said second panel, and said peripheral side wall each being formed of a flexible material such that said panels and side wall are rollable into a roll, said sheath having a central axis extending through said opening into said cavity, a cross-sectional area of said opening taken in a plane oriented perpendicular to said central axis being substantially equal to a cross-sectional area of said cavity taken in a plane oriented perpendicular to said central axis for facilitating insertion of bristles of the painting utensil through said opening, each of said panels and said peripheral side wall being made of an elastomeric material; and providing a shoulder, said shoulder being generally adjacent to and securely attached to said fourth edges of said first panel, said second panel, and said peripheral side wall and extending around said opening and said shoulder extending around said opening in a manner that does not constrict the cross sectional area of said opening smaller than the cross sectional area of said cavity, said shoulder being made of an elastic material;

rolling said shoulder back upon itself to gather said first panel, said second panel, and said peripheral wall to define a pre-use position; and unrolling said shoulder over the length of said bristles of said painting utensil, said shoulder being selectively in contact with said base of said painting utensil creating a seal;

whereby said seal prevents the drying out of said painting utensil.

* * * * *